United States Patent [19]

Kunzli et al.

[11] Patent Number: 4,812,619

[45] Date of Patent: Mar. 14, 1989

[54] ELECTRODE BOILER AND AN INSULATOR THEREFOR

[75] Inventors: Albert Kunzli, Wiesendangen; Kurt Schutz, Winterthur, both of Switzerland

[73] Assignee: Sulzer Brothers Limited, Winterthur, Switzerland

[21] Appl. No.: 57,488

[22] Filed: Jun. 3, 1987

[30] Foreign Application Priority Data

Jun. 18, 1986 [CH] Switzerland ..... 2461/86

[51] Int. Cl.[4] ..... H05B 3/60

[52] U.S. Cl. ..... 219/288

[58] Field of Search ..... 219/288–290; 174/211, 209; 338/82

[56] References Cited

U.S. PATENT DOCUMENTS 4,292,498 9/1981 Rouf ..... 219/288

4,314,139 2/1982 Williams et al. ..... 219/285

*Primary Examiner*—Clifford C. Shaw

*Assistant Examiner*—M. M. Lateef

*Attorney, Agent, or Firm*—Kenyon & Kenyon

[57] ABSTRACT

The electrode boiler is provided with an electrical insulator of ceramic material which is provided with a layer of fluoroplastic material to protect against water deposits thereon. The protected layer may be formed of polytetrafluoroethylene and is of a thickness of from 20 to 50 μm.

9 Claims, 1 Drawing Sheet

ELECTRODE BOILER AND AN INSULATOR THEREFOR

BACKGROUND OF THE INVENTION

This invention relates to an electrode boiler and to an insulator therefor. More particularly, this invention relates to an electrode boiler for producing steam or hot water.

Heretofore, various types of electrode boilers have been known for the production of steam or hot water. Generally, such electrode boilers are constructed with a vessel which is partly filled with water and which contains at least one electrode which can be connected to an alternating-current power supply in order to heat the water within the vessel. In addition, the electrode has been mounted within the vessel by means of an electrical insulator of ceramic material which is situated above the level of the water.

Generally, boilers of the above type have a counter electrode associated with the electrode and which is also electrically connected to the vessel. In such cases, water falling between the electrode and the counter electrode forms an electrical current path. However, during operation, it has been observed that substances contained in the water are carried by the steam that forms and/or by splashes of water into the insulator area and are deposited on the surface of the insulator in the form of crystals. As a result, a dangerous condition can be presented if the deposits coalesce to form electrically conductive layers which are liable to cause short circuits Further, the deposits attack the ceramic insulator chemically so that the surface of the insulator progressively roughens so as to favor the creation of deposits and, thus, increase the risk of short circuits. As a result, the insulators must be changed frequently causing undesirable interruptions in operation.

Accordingly, it is an object of the invention to reduce or completely avoid the depositing of water deposits on an insulator of an electrode boiler.

It is another object of the invention to prevent the accumulation of water deposits on an insulator for an electrode boiler.

PREFERRED EMBODIMENT OF THE INVENTION

Briefly, the invention provides an insulator for an electrode boiler which is comprised of a ceramic electrical insulator having a layer of fluoroplastic material thereon of a thickness sufficient to prevent built-up of water deposits thereon. In this respect, the layer of fluoroplastic material may have a thickness of from 20 to 50 μm.

The insulator is suitable for use in an electrode boiler having a vessel for receiving a supply of water, at least one electrode in the vessel for heating the water and means for connecting the electrode to an alternating-current power supply. In this respect, the electrical insulator serves to mount the electrode in the vessel.

By coating at least that part of the insulator surface which is exposed to steam and/or splashes of water, the occurrence of water deposits on the insulator can be substantially reduced if not eliminated. In this respect, extended time tests have shown that substantially no deposits occur on the extremely smooth fluoroplastic layer on the insulator. Hence, corrosion of the insulator and a subsequent need for replacement of the insulator and the risk of short circuits are eliminated. As a result, an electrode boiler employing such an insulator can be operated on a more economical basis.

The fluoroplastic material used for the coating may be a polytetrafluoroethylene which is particularly advantageous at high temperatures as occur in steam-generating electrode boilers.

These and other objects and advantages of the invention will become more apparent from the following detailed description taken in conjunction with the accompanying drawings wherein:

BRIEF DESCRIPTION OF THE DRAWINGS

FIG. 2*b* illustrates a cross sectional view of an enlarged detail of the insulator of FIG. 2*a.

DETAILED DESCRIPTION OF THE DRAWINGS

Figure 1:
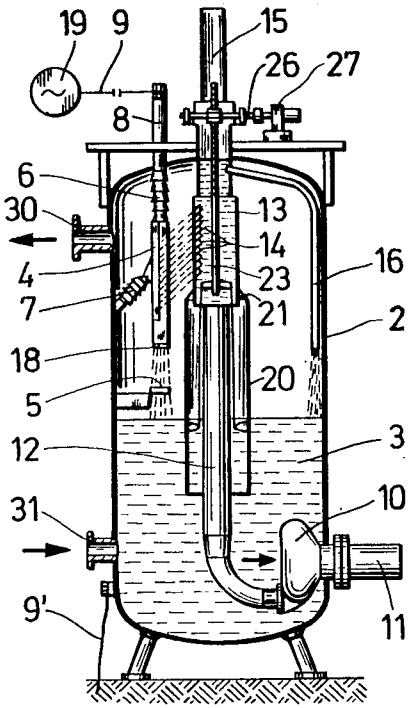
FIG. 1 illustrates a cross sectional view of an electrode boiler of water jet type employing an insulator in accordance with the invention.

Referring to FIG. 1, the electrode boiler is of a water jet type and includes a cylindrical vertically disposed vessel 2 which is closed at both ends and which is filled approximately half full of water 3. As illustrated, the boiler has an electrode 4 for heating the water which is supported by a ceramic electrical insulator 6 to depend downwardly from an upper end of the vessel 2. This insulator 6 insulates the electrode 4 electrically from the vessel 2 while another ceramic insulator 7 supports the electrode 4 against the vertical wall of the vessel 2 in order to prevent horizontal deflection of the electrode 4, for example, in the event of earthquakes.

A pump 10 which is driven by an electric motor 11 and which is submerged in the water 3 supplies water through a central riser 12 to a nozzle assembly 13 and into an adjoining housing 15 provided with an overflow duct 16 through which water flows back into the lower part of the vessel 2.

The nozzle assembly 13 has a series of nozzles 14 which are arranged vertically one above the other to form parallel water jets which are directed onto the electrode 4. The water which strikes the electrode 4 falls unto a nozzle plate 18 which is in the form of a perforated sheet and which is attached to the lower end of the electrode 4.

A counter electrode 5 is positioned between the nozzle plate 18 and the level of water in the vessel 2. This counter electrode 5 is in the form of a metal plate containing vertically disposed bores and is attached to the vessel 2 in an electrically conductive manner as is known.

Figure 2A:
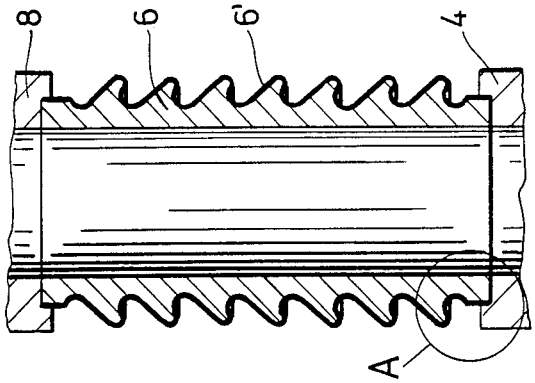
FIG. 2*a* illustrates a cross sectional view of an insulator constructed in accordance with the invention.
Figure 2B:
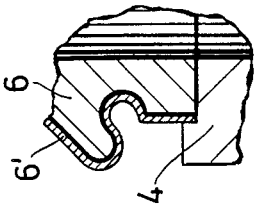

Referring to FIG. 2*a*, the upper insulator 6 is substantially tubular and is rigidly connected at the bottom to the electrode 4 and at the top to a penetration duct 8 by fastening means (not shown). In addition, a means in the form of a conductor 9 is provided for connecting the electrode 4 to an alternating-current power supply 19. As indicated, the conductor 9 extends from the electrode 4 through a bore of the insulator 6 and through the duct 8 in electrically insulated manner to the power supply 19.

The insulator 7 which is of similar construction to the insulator 6 has one end connected rigidly to the wall of the vessel 2 and the opposite end pivotally connected to the electrode 4. The vessel 2 is also provided with an earth lead 9' so that the water jets between the nozzle plate 18 and the counter electrode 5 form a current path for the alternating current. Because of the electrical resistance of the water jets, the water in the jets is heated and partially evaporates. The resulting steam escapes through an outlet spigot 30 in the vessel 2 to consuming devices (not shown). A suitable inlet spigot 31 is also provided in the wall of the vessel 2 in order to supply the water into the vessel 2.

The output of the electrode boiler is controlled by means of a cylindrical, vertically movable regulating hood 20 which is placed around the riser 12 and nozzle assembly 13. This hood 20 carries a wiper ring 21 at the upper end which slides over the nozzle assembly 13. In order to effect axial motion of the hood 20, a vertical coaxial rack 23 is connected to the hood 20 and engages a gear which is driven by way of a shaft 26 via a reversible gear motor 27. The more the regulating hood 20 is raised, the more nozzles 14 are covered by the wiper ring 21 and the fewer water jets are impinged on the electrode 4 so that the quantity of water reaching the counter electrode 5 is reduced as is the quantity of steam.

The electrical conductivity of the water can be optimized by adding electrolytes (salts or bases). However, these and other substances contained in the water tend to be deposited in crystal form in the interior of the vessel 2. Insofar as this affects the insulators 6, 7 above the water level, the deposits may have serious consequences. In order to prevent such deposits on the insulators 6, 7, each insulator 6, 7 is coated with a layer 6' of fluoroplastic material, for example polytetrafluoroethylene, which is so smooth and resistant to chemical attack that no appreciable deposits occur. As indicated in FIG. 2*a*, the protective layer 6' extends over the entire external surface of the insulator 6.

In order to apply the layer 6', the surface of a fired ceramic member is roughened, for example by sand blasting and provided with a base coat of approximately 10 μm of a fluoroplastic material which is then allowed to dry thoroughly. The base coat is then fired whereupon at least one cover coat of fluoroplastic of from 10 to 20 μm thickness is applied and dried thoroughly. Each cover coat is subsequently baked individually.

Figure 3:
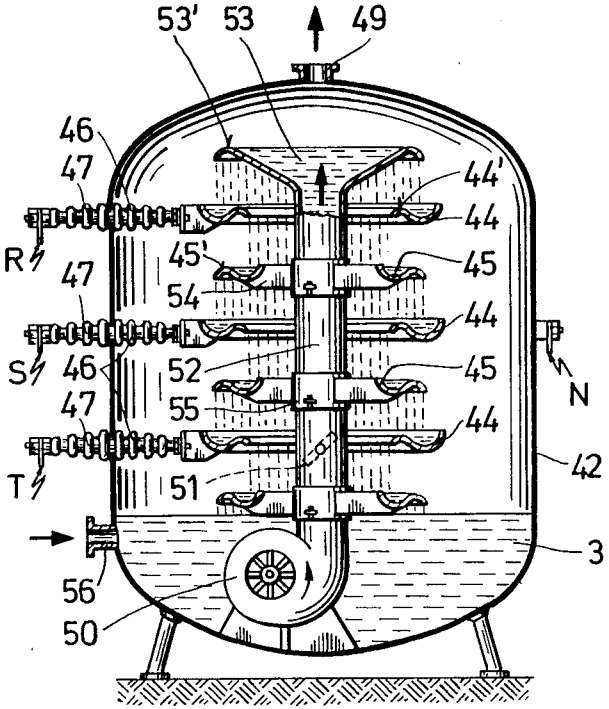
* and FIG. 3 illustrates an electrode boiler which operates on a waterfall principle employing an insulator in accordance with the invention.

Referring to FIG. 3, the electrode boiler may be constructed on the overflow or waterfall principle. In this respect, the boiler has a vessel 42 which houses three electrodes in the form of annular dishes 44 arranged vertically one above the other around a riser 52 and above the water level. Each annular dish 44 is carried by a radial rod which extends through an inner insulator 46 and an outer insulator 47 and which passes through a vertical wall of the vessel 42. The three rods are also connected to the respective phases R, S, T, of a three phase alternating-current power supply.

The boiler vessel 42 rests on the ground in an electrically insulated manner and is connected to a neutral phase N of the alternating-current power supply. In addition, a pump 50 feeds water through the riser 52 which contains a control valve 51 into a dish 53 provided with a horizontal overflow edge 53'.

Three annular dishes 45 are secured to the riser 52 by collars 55 by way of three respective arms 54 in such a way as to be adjustable in height. These dishes 45 function as counter electrodes and alternate with the dishes 44.

As illustrated, the cross section of each of the annular dishes 44, 45 is in the shape of a prone "S". In addition, each dish 44 has an internal rounded edge which forms an overflow edge 44' parallel to the overflow edge 53' of the dish 53 and the outer edge ends at a higher level than the overflow edge 44'. The S-shaped cross sections of the dishes 45 are arranged in mirror image so that an outer rounded edge of each forms an overflow edge 45' parallel to the overflow edge 53' of the dish 53.

During operation, water flows over the overflow edge 53' of the dish 53 onto the annular dish 44 immediately therebelow. Thereafter, the water flows over the inner overflow edge 44' into the next annular dish 45 and so on down to the level of the water 3 in the bottom of the vessel 42. The electrical current flows through the overflowing water between the dishes 44 functioning as electrodes and the dishes 45 functioning as counter electrodes which are electrically connected to the vessel 42. Heating of the overflowing water produces steam which escapes through a steam outlet spigot 49 in the upper end of the vessel 42. An inlet spigot 56 is also provided in the vessel 42 for the supply of water.

By adjusting the height of the dishes 45 which function as counter electrodes, the height of waterfall can be set so that the resistances in the three phases remain equal although the quantity of water diminishes from the top downwards due to the evaporation of water. In this way, non-uniform loading of the three phases is avoided.

The output of the waterfall electrode boiler is controlled by using the control valves 51 to adjust the quantity of water circulated and possibly by changing the speed of the pump 50.

As in the embodiment illustrated in FIG. 1, the inner insulators 46 inside the vessel 42 are exposed to salt deposits due to splashes and steam. Accordingly, these insulators 46 are coated with a fluoroplastic material, preferrably of polytetrafluorethylene in the manner as described above.

Both in the water jet electrode boiler illustrated in FIG. 1 and the waterfall electrode boiler illustrated in FIG. 3, the output may be adjusted so that only hot water is produced. In such a case, the temperature may be so low that instead of using polytetrafluoroethylene, an elastomeric fluoroplastic, for example of the formula $$(CH_2-CF_2)_m-(CF_2-\underset{\underset{CF_3}{|}}{CF})_n$$

can be used as the coating 6' for the insulators 6, 7 or 46. This elastomeric fluoroplastic exhibits more elasticity than polytetrafluoroethylene, which may be advantageous with respect to mechanical stresses.

The coated insulators may also be used in other types of electrode boilers, for example, those in which the electrode and counter electrode are arranged coaxially one inside the other and entirely immersed in water.

The thickness of the fluoroplastic layer 6' on the insulators is so slight that the electrical insulating properties of the layer are negligible. In this respect, the layer 6' is of a thickness sufficient to prevent build-up of water deposits thereon and, preferrably, is of a thickness of from 20 to 50 μm.

The invention thus provides an insulator for use in an electrode boiler which resists the build-up of water deposits thereon. As such, the insulator reduces the risk of short circuits occurring while also protecting the insulator from surface corrosion.

The invention further provides an insulator which can be used in an electrode boiler to extend the life of the boiler.

What is claimed is:

1. An electrode boiler comprising a vessel for receiving a supply of water;

at least one electrode in said vessel for heating said water therein;

means for connecting said electrode to an alternating-current power supply;

an electrical insulator of ceramic material mounting said electrode in said vessel; and a layer of fluoroplastic material on said insulator.

2. An electrode boiler as set forth in claim 1 wherein said material is polytetrafluoroethylene.

3. An electrode boiler as set forth in claim 1 wherein said layer is of a thickness of from 20 to 50 μm.

4. An insulator for an electrode boiler comprising a ceramic electrical insulator; and a layer of fluoroplastic material on said insulator.

5. An insulator as set forth in claim 4 wherein said layer is of a thickness sufficient to prevent build-up of water deposits thereon.

6. An insulator as set forth in claim 5 wherein said layer is of a thickness of from 20 to 50 μm.

7. An insulator as set forth in claim 5 wherein said material is polytetrafluoroethylene.

8. An insulator as set forth in claim 5 wherein said material is an elastomeric fluoroplastic of the formula $$(CH_2-CF_2)m-(CF_2-\underset{CF_3}{CF})n.$$

9. An electrode boiler as set forth in claim 1 wherein said material is elastomeric fluoroplastic of the formula $$(CH_2-CF_2)m-(CF_2-\underset{CF_3}{CF})n.$$

* * * * *